US011787623B2

(12) United States Patent
Crespo et al.

(10) Patent No.: US 11,787,623 B2
(45) Date of Patent: Oct. 17, 2023

(54) SINGLE SERVE CAPSULE HAVING WEAK POINTS AND THINNED POINTS IN THE CAPSULE BASE

(71) Applicant: GEORG MENSHEN GMBH & CO. KG, Finnentrop (DE)

(72) Inventors: Lorenzo Crespo, Sant Feliu de Llobregat (ES); Jordi Guijarro, Torrelles de Llobregat (ES); Marti Nogue I Arbusa, Barcelona (ES); Aida Llacuna Gorriz, Cd Nijmegen (NL)

(73) Assignee: GEORG MENSHEN GMBH & CO. KG, Finnentrop (DE)

( * ) Notice: Subject to any disclaimer, the term of this patent is extended or adjusted under 35 U.S.C. 154(b) by 221 days.

(21) Appl. No.: 16/979,863

(22) PCT Filed: Apr. 27, 2018

(86) PCT No.: PCT/EP2018/000224
§ 371 (c)(1),
(2) Date: Sep. 11, 2020

(87) PCT Pub. No.: WO2019/174702
PCT Pub. Date: Sep. 19, 2019

(65) Prior Publication Data

US 2021/0024284 A1 Jan. 28, 2021

(30) Foreign Application Priority Data

Mar. 15, 2018 (DE) ..... 10 2018 002 102.6

(51) Int. Cl.
*B65D 85/804* (2006.01)

(52) U.S. Cl.
CPC ..... *B65D 85/8043* (2013.01); *B65D 85/8049* (2020.05); *B65D 85/8052* (2020.05)

(58) Field of Classification Search
CPC ..... B65D 85/8049; B65D 85/8043; B65D 85/8052
See application file for complete search history.

(56) References Cited

U.S. PATENT DOCUMENTS 5,948,455 A 9/1999 Schaeffer et al.
2003/0172813 A1* 9/2003 Schifferle ..... A47J 31/0673 99/275

(Continued)

FOREIGN PATENT DOCUMENTS

CN 204427705 U 7/2015
CN 106029526 A 10/2016

(Continued)

OTHER PUBLICATIONS

EP 3 144 250, Guijarro et al., Sep. 2017, Machine Translation.*

*Primary Examiner* — Drew E Becker
*Assistant Examiner* — Chaim A Smith
(74) *Attorney, Agent, or Firm* — Norman B. Thot

(57) ABSTRACT

A single-serve capsule for preparing a beverage in a beverage apparatus. The capsule includes an inlet end, an outlet end arranged opposite to the inlet end, and a capsule base which closes the outlet end. The capsule base includes an outside area, an outside edge, weak points which open, break and/or tear as a result of a fluid pressure of hot water in the interior of the capsule, and arcuate thin spots arranged next to each of the weak points. The arcuate thin spots provide for a uniform guidance of a plastic melt, do not break or tear open under the fluid pressure of the hot water, and form ramp-like sloping surfaces to increase a surface of the accurate thin spots upon which the fluid pressure of the hot water acts.

13 Claims, 8 Drawing Sheets

(56) References Cited

U.S. PATENT DOCUMENTS

| | | | | |
|---|---|---|---|---|
| 2008/0257165 | A1 | 10/2008 | Bolzicco et al. | |
| 2013/0064936 | A1 | 3/2013 | Meelker et al. | |
| 2014/0290494 | A1* | 10/2014 | Chia ..... | B65D 85/8061 99/295 |
| 2015/0232263 | A1 | 8/2015 | Talon | |
| 2018/0178972 | A1 | 6/2018 | Mondillon et al. | |

FOREIGN PATENT DOCUMENTS

| | | | |
|---|---|---|---|
| EP | 1 555 218 | A1 | 7/2005 |
| EP | 2 957 524 | A1 | 12/2015 |
| EP | 3 144 250 | A1 | 3/2017 |
| EP | 3 348 494 | A1 | 7/2018 |
| WO | WO 2015/113758 | A1 | 8/2015 |

* cited by examiner

SINGLE SERVE CAPSULE HAVING WEAK POINTS AND THINNED POINTS IN THE CAPSULE BASE

CROSS REFERENCE TO PRIOR APPLICATIONS

This application is a U.S. National Phase application under 35 U.S.C. § 371 of International Application No. PCT/EP2018/000224, filed on Apr. 27, 2018 and which claims benefit to German Patent Application No. 10 2018 002 102.6, filed on Mar. 15, 2018. The International Application was published in German on Sep. 19, 2019 as WO 2019/174702 A1 under PCT Article 21(2).

FIELD

The present invention relates to a single-serve capsule made of plastic for preparing a beverage such as coffee or tea in a beverage apparatus, the capsule being closed at its outlet end by a capsule base and being perforated at its opposite inlet end by a device to allow hot water to be pressed into the capsule interior which contains a beverage substrate, beverage granules, or a beverage powder, the capsule base having weak points which in the presence of fluid pressure in the capsule interior open, break, or tear in order to allow liquid to pass from the interior of the capsule to the outside.

BACKGROUND

EP 0 806 373 B1 describes providing elongated weak points at the bottom of a single-serve capsule made of aluminum which tear open in the presence of pressure exerted by hot water. These weak points do not, however, always tear open reliably, in particular if the hot water pressed in does not always exhibit a sufficiently high pressure.

SUMMARY

An aspect of the present invention to provide an improved single-serve capsule of the kind mentioned above which provides a reliable flow through the capsule with differing hot water pressures, a greater wall thicknesses of the base, a low generation of noise, and a uniform distribution of the plastic melt.

In an embodiment, the present invention provides a single-serve capsule which is made of a plastic for preparing a beverage in a beverage apparatus. The single-service capsule includes an inlet end which is configured to be perforated by a device to allow hot water to be pressed into an interior of the single-serve capsule in which a beverage substrate, beverage granules, or a beverage powder is provided, an outlet end which is arranged opposite to the inlet end, and a capsule base which is configured to close the outlet end. The capsule base comprises an outside area, an outer edge, weak points which are configured to at least one of open, break and tear as a result of a fluid pressure of the hot water in the interior of the single-serve capsule so as to allow a liquid to pass from the interior of the single-serve capsule to an outside of the single-serve capsule, and arcuate thin spots arranged next to each of the weak points. The arcuate thin spots are configured to provide for a uniform guidance of a plastic melt, to not break or tear open under the fluid pressure of the hot water, to form ramp-like sloping surfaces so as to increase a surface of the accurate thin spots upon which the fluid pressure of the hot water acts, and to project upwards from the outside area of the capsule base and to rise towards the outer edge of the capsule base so that an outer highest edge of each of the accurate thin spots is more distant from the inlet end than a remaining part of an area of the capsule base.

BRIEF DESCRIPTION OF THE DRAWINGS

The present invention is described in greater detail below on the basis of embodiments and of the drawings in which.

DETAILED DESCRIPTION

Figure 1:
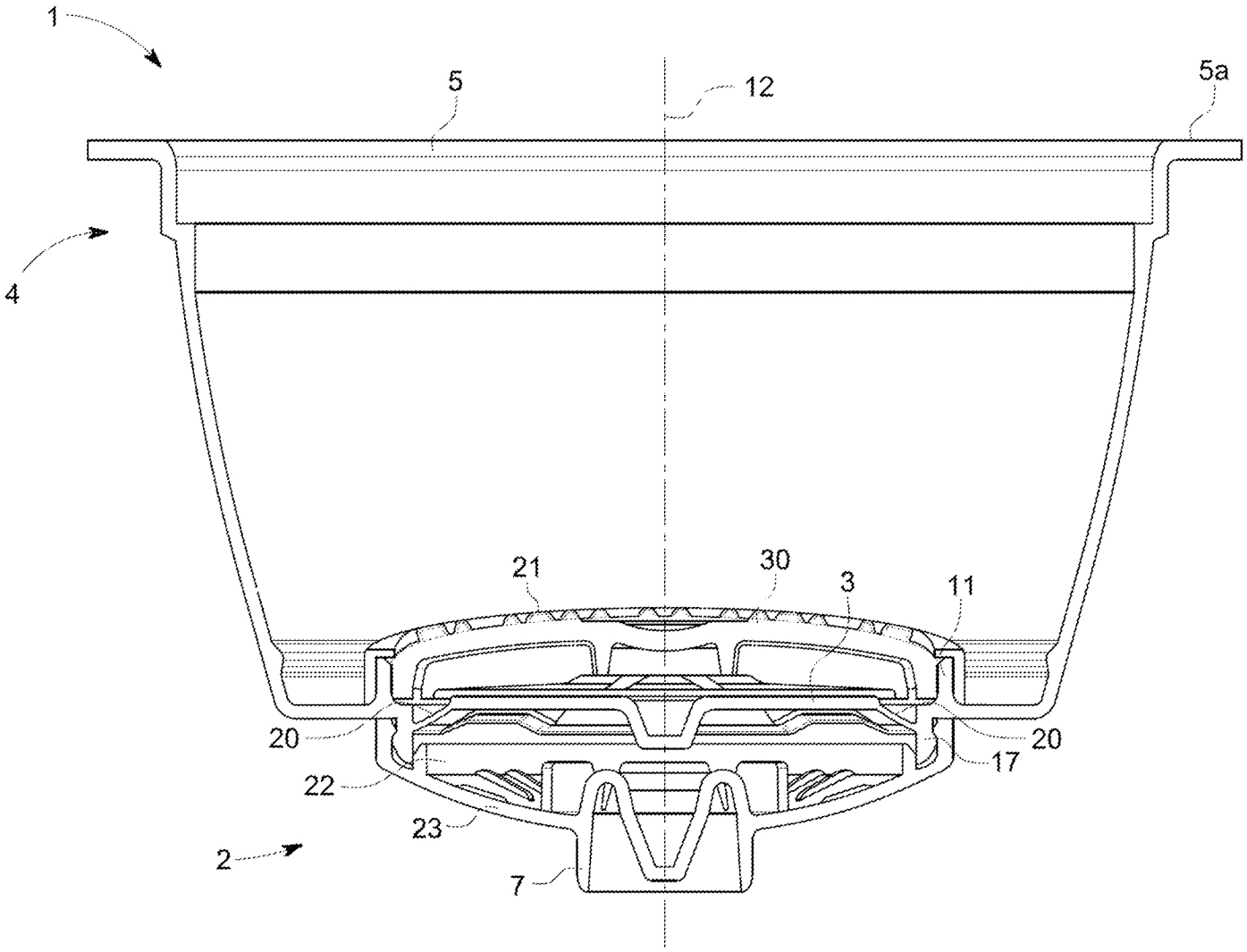
FIG. 1 shows an axial section through the single-serve capsule in the area of two thin spots.
Figure 2:
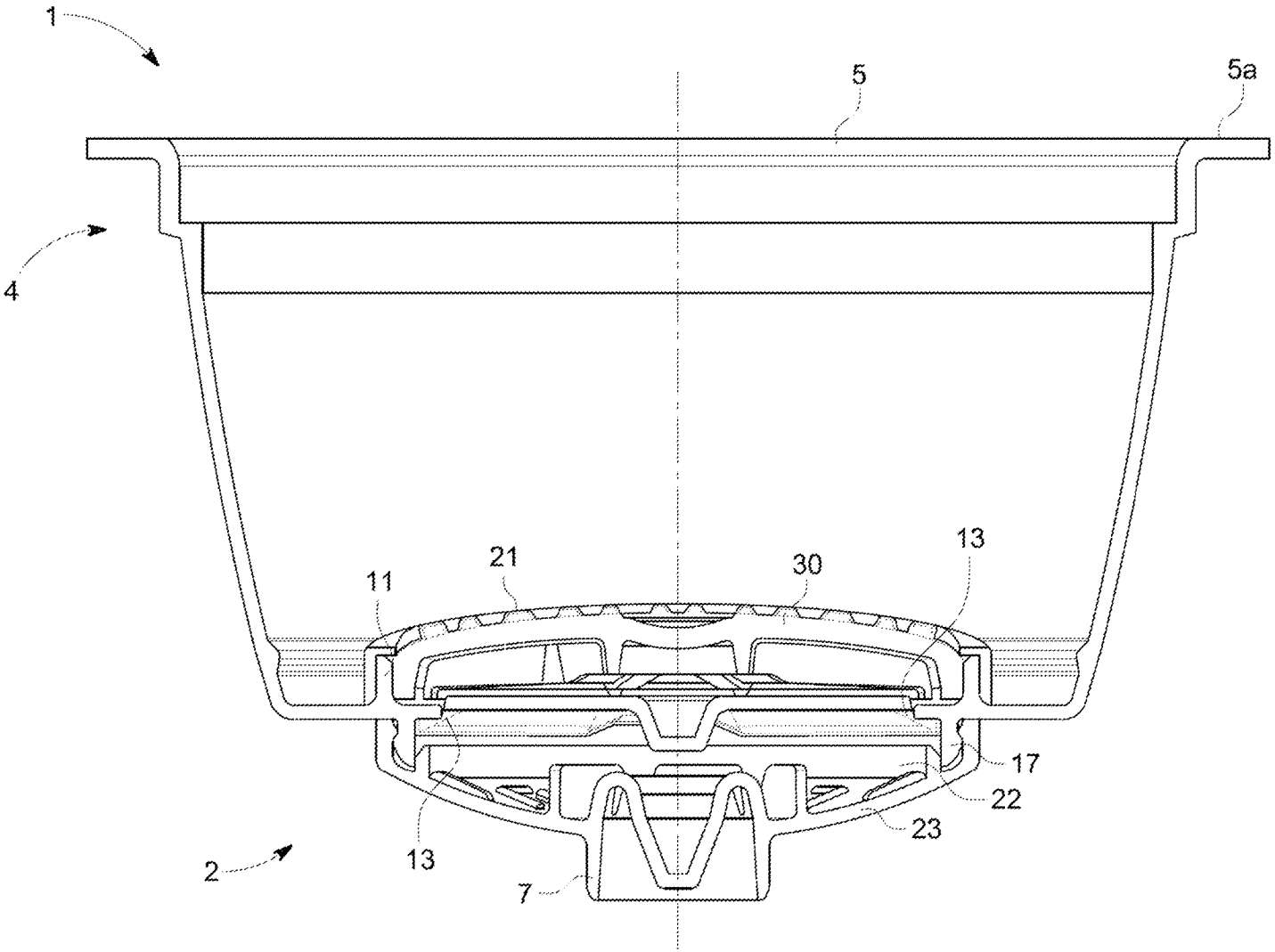
FIG. 2 shows an axial section through the single-serve capsule in the area of two weak points.

The present invention provides that the capsule base next to the weak points exhibits arcuate thin spots for the uniform guidance of the plastic melt which neither break nor tear open under the pressure of the hot water and that the arcuate thin spots have ramp-like sloping surfaces.

The sloping ramp shape of the thin spots increases the surface opposing the hot liquid and, as a result of its sloping position, also offers an optimum area of attack so that the thin spots move to such an extent that their respective two ends exert tensile or compressive forces on the weak points so that the weak points tear more easily even if the base in the area of the weak points exhibits a greater thickness. The thin spots also achieve an optimum distribution of the plastic melt.

It is thereby particularly advantageous if the thin spots project upwards from the outside area of the capsule base and rise towards the outer edge of the capsule base so that the outer highest edges of the thin spots are more distant from the inlet end than the remaining part of the area of the capsule base.

The single-serve capsule can, for example, have circular-arc-shaped thin spots which have the shape of a sector of the wall of a hollow truncated cone.

For the production and the function, it is particularly advantageous if the weak points and the thin spots lie on a circle that shares its axis with the center axis of the capsule. Three to six, in particular, four, weak points can thereby be arranged at identical intervals on the circle, and the intermediate circular spaces between the weak points can be filled by circular-arc-shaped thin spots of the same number. The thin spots can, for example, have a circular arc length of 50 to 85 degrees, and the weak points a circular arc length of 5 to 20 degrees. The thin spots thereby include the transitional areas mentioned below.

A particularly advantageous development is provided if the thin spots and the weak points border on one another, in each case with a transitional area through which the thin spots exert tensile and/or compressive forces on the weak points when hot water flows in. This provides a reliable breaking or tearing open of the weak points.

The single-serve capsule, its base, and its thin spots and weak points can have the different dimensions. The weak points can, for example, have a wall thickness of 0.10 to 0.30 mm, for example, approximately 0.14 to 0.23 mm, and that the thin spots can, for example, have a wall thickness of 0.20 to 0.30 mm, for example, approximately 0.25 mm. The weak points can have a width of 0.10 to 0.30 mm, for example, approximately 0.20 mm, and thin spots can have a width of 1.0 to 2.0 mm, for example, approximately 1.3 mm.

A significant improvement in the quantity and density of the crema is achieved if the capsule base is covered by an inner plate, in particular as a straining area, which has numerous liquid passage openings, in particular between the annular groove and the upward curved annular zone.

The outlet side of the capsule is protected if the capsule base of the outlet end is covered by a hood which has at least one liquid outlet opening.

The inner plate can, for example, extend with its outer edge to the external wall of the pot-shaped capsule. The outer edge can thereby have an upward curved annular zone which abuts the inside of the external wall.

An embodiment of the present invention is shown in the drawings and is described in greater detail below.

The single-serve capsule 1 according to the present invention is designed to be inserted into a beverage apparatus, in particular into a coffee or tea machine, to produce a beverage, in particular coffee or tea, from a substrate, granules or powder inside the capsule. The single-serve capsule 1 is pot-shaped with an external wall 1*a* which holds the substrate, granular material, or powder. The single-serve capsule 1 is open at one end, in this case the inlet end 4, this opening 5 being closed by a film or a foil which is affixed on the flange-like edge 5*a* of the single-serve capsule 1 so that the opening 5 is reliably closed. This provides that after the film or foil has been punched by at least one tube, in particular a lance, the liquid, in particular hot or cold water, entering through the tube/lance enters into the single-serve capsule 1.

The single-serve capsule 1 is formed by a pot-shaped housing made of a plastic material and has a lower capsule base 3 on which an annular, cylindrical projection (first annular projection 11) is molded which projects into the interior of the single serve capsule 1 and whose axis is identical with the capsule axis 12. The inside diameter of the first annular projection 11 is equivalent to ⅓ to ¾ of the diameter of the opening 5. The height and/or width of the first annular projection 11 is 2 to 6 mm.

The single-serve capsule 1 has in its lower capsule base 3 within the first annular projection 11 circular-arc-shaped weak points 13 in the plastic material of the single-serve capsule 1 which in the presence of fluid pressure inside the single-serve capsule 1 open, break, or tear in order to allow liquid to pass from the interior of the single-serve capsule 1 to the beverage outlet 7. The weak points 13 can, for example, consist of tear lines. The weak points 13 may also be tear notches, tear seams, or any other form of weakening.

Figure 3:
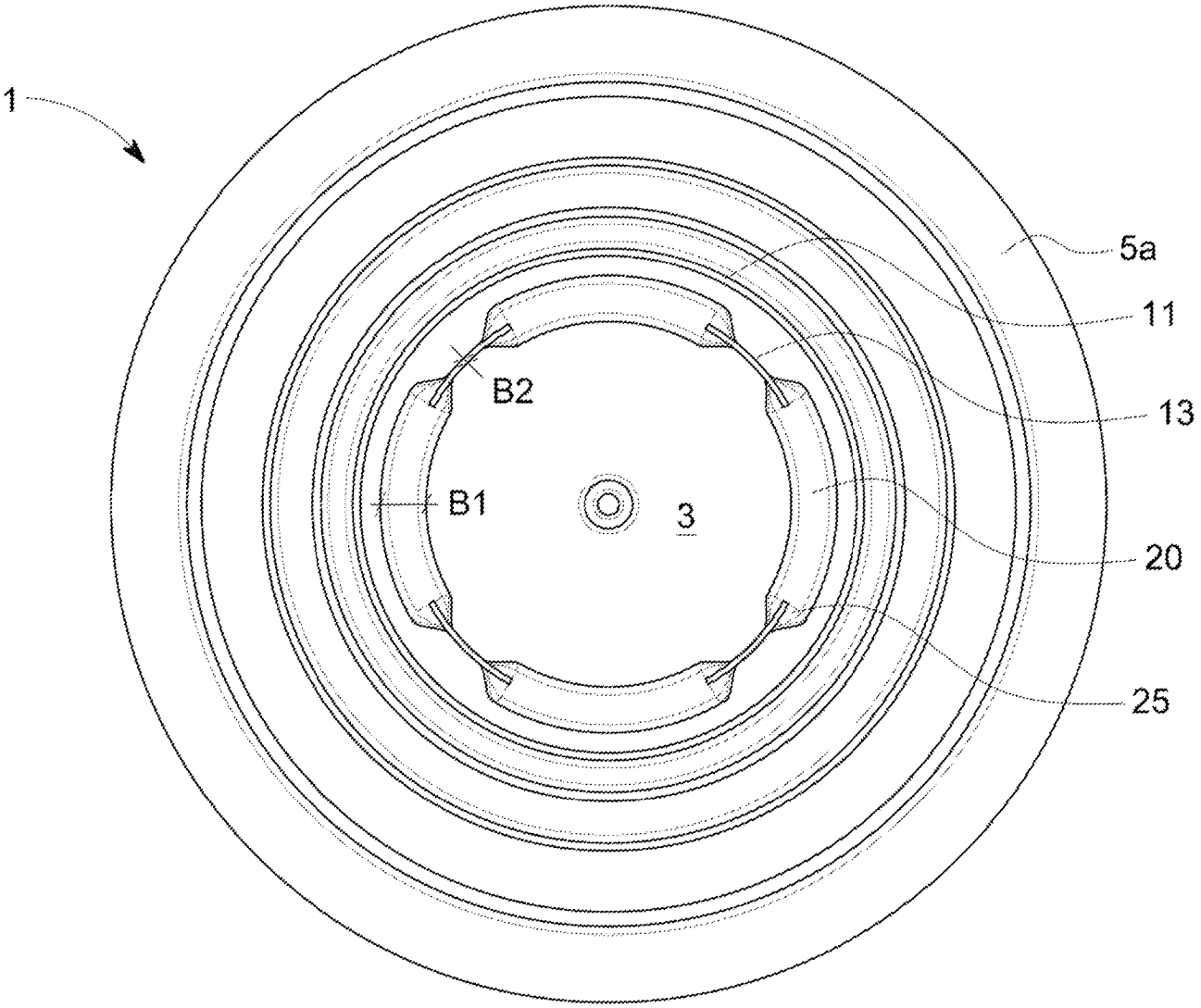
FIG. 3 shows a top view of the single-serve capsule without an upper cover.
Figure 4:
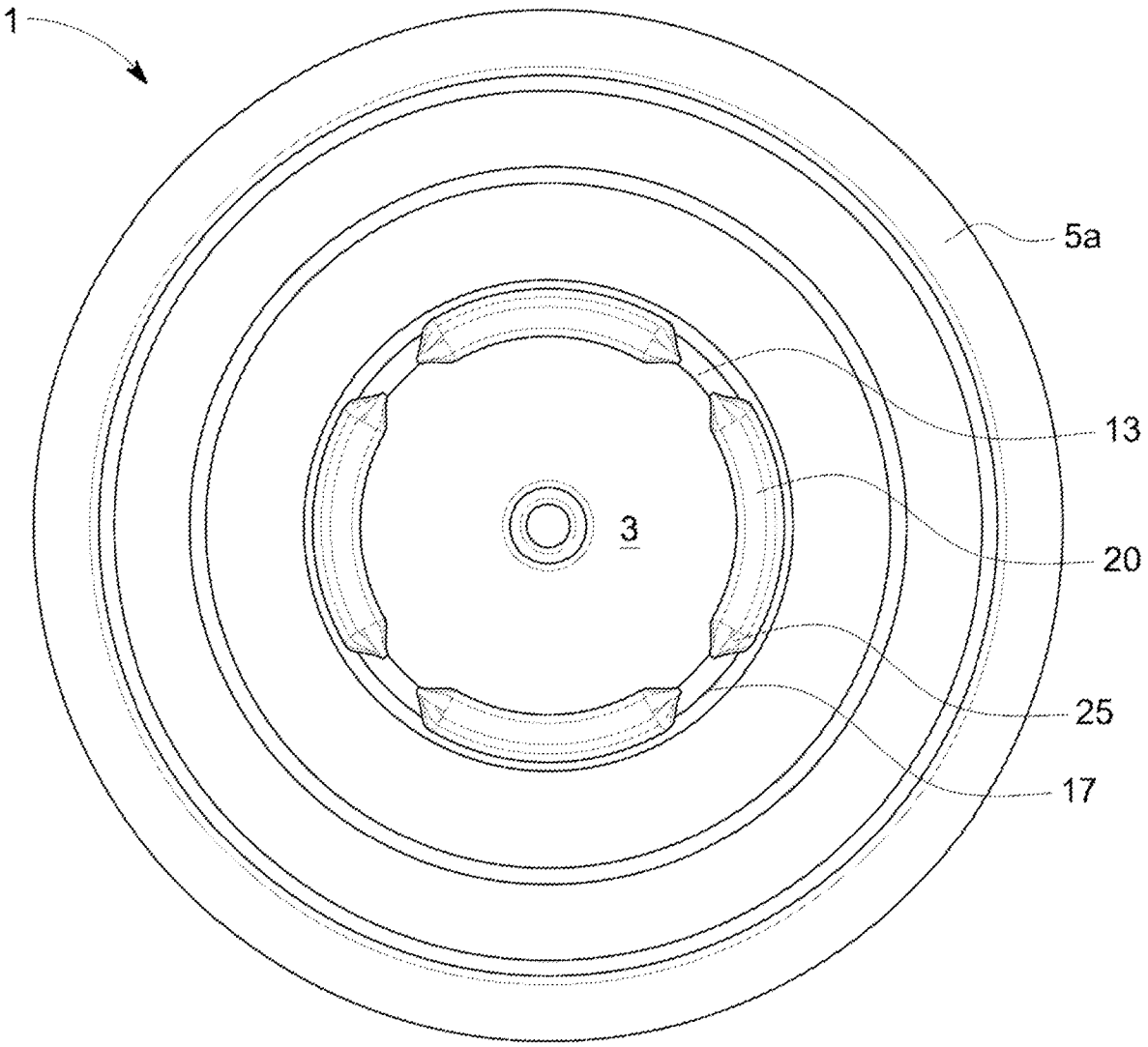
FIG. 4 shows a bottom view of the single-serve capsule without a bottom cover.
Figure 5:
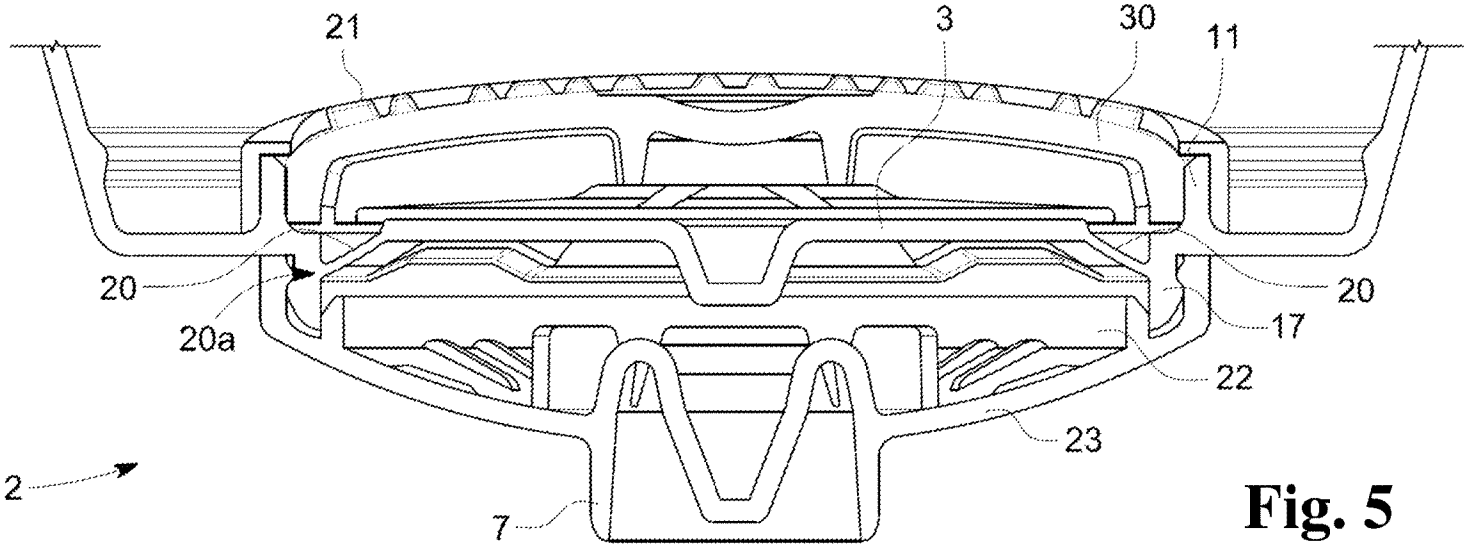
FIG. 5 shows an enlarged view of the base area of FIG. 1.
Figure 6:
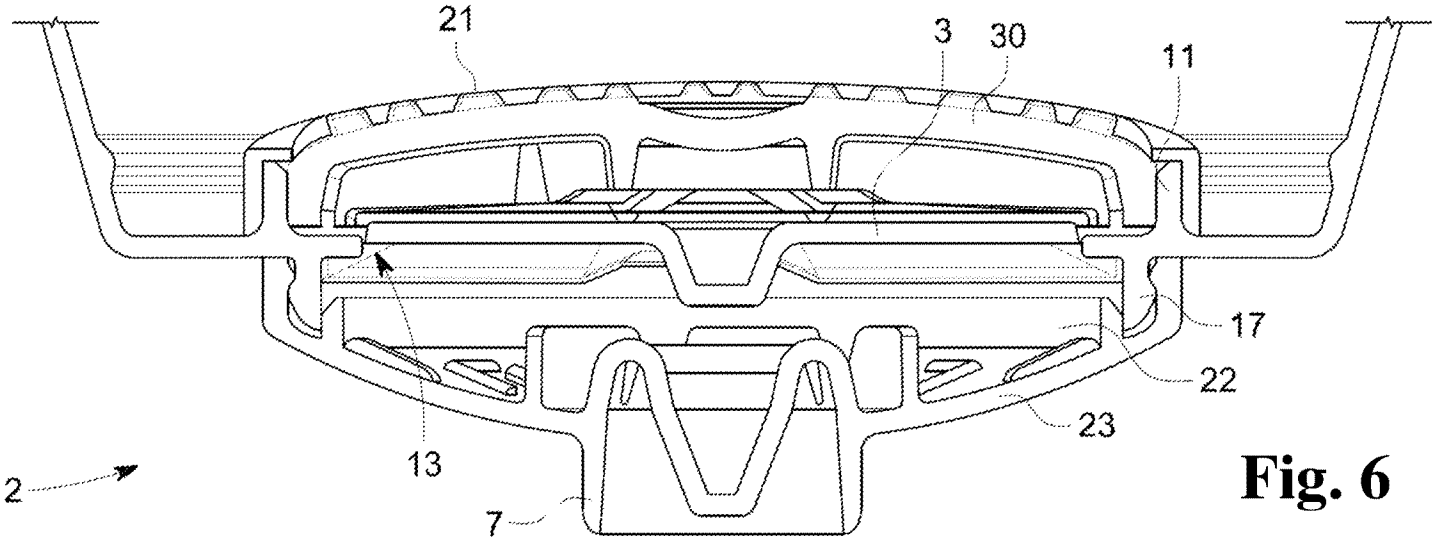
FIG. 6 shows an enlarged view of the base area of FIG. 2.

In the embodiment shown in FIG. 3, the lower capsule base 3 of the single-serve capsule 1 has four, in particular circular-arc-shaped, weak points 13 that are evenly distributed along a circle which is arranged near the base edge so as to be centric and hence coaxial with the center axis 12 of the single-serve capsule 1. At the weak points 13, the plastic material of the lower capsule base 3 has such a low thickness that the plastic material there breaks/tears open as a consequence of the fluid pressure built up in the interior of the single serve capsule 1.

The single-serve capsule 1 can, for example, be produced via a plastic injection molding process or a compression molding process. It is thereby important that during the injection of the melt into the middle of the injection mold cavity forming the lower capsule base 3, that the plastic melt flows evenly from the middle to the circular edge of the lower capsule base 3. This flow is, however, impeded by the weak points 13 as thin spots which each generate a resistance to the flow and hinder the melt flow. In order to nevertheless achieve an even flow to the outer edge of the lower capsule base 3 and also to the external wall 1*a* of the single-serve capsule 1, four circular-arc-shaped thin spots 20 are arranged between the, for example, four weak points 13, the thin spots 20 lying on the circle on which the weak points 13 are also arranged and whose center is also the center of the lower capsule base 3 of the single-serve capsule 1 which is also the point of the gate of the single-serve capsule 1.

The material has a higher thickness at the thin spots 20 than at the weak points 13 so that, as a result of the fluid pressure built up inside the single-serve capsule 1, only the weak points 13 and not the thin spots 20 tear or break open.

In order to provide that during the injection of the melt the resistance to flow over the entire periphery of the circle and hence at the thin spots 20 is as high as at the weak points 13, the thin spots 20 have a larger radial width B1 than the radial width B2 of the weak points 13 (FIG. 3).

Four circular-arc-shaped weak points 13 and four circular-arc-shaped thin spots 20 which are respectively arranged there-between are, for example, arranged to together form a continuous circle. A circle may instead also be formed by a configuration of three, five, or six weak points and thin spots.

The lower capsule base 3 of the single-serve capsule 1, the weak points 13 and the thin spots 20 can, for example, have the following dimensions:

| | Thickness (mm) | Width (mm) | Circular Arc Length (degrees) |
|---|---|---|---|
| Lower capsule base 3 | 0.5 to 1.0 preferably 0.7 | — | — |
| Weak points 13 | 0.10 to 0.30 preferably 0.14 to 0.23 | 0.1 to 0.3 preferably 0.2 | 3° to 20° preferably 10° to 40° |
| Thin spots 20 | 0.20 to 0.30 preferably 0.25 | 0.7 to 2.0 preferably 1.3 | 50° to 85° preferably 80° |

A strainer 21 lying above the lower capsule base 3 restrains substrate particles. Instead of the strainer 21 or in addition to the strainer 21, the lower capsule base 3 is covered by an inner plate 30 which allows the liquid to pass through to the lower capsule base 3 around its edge. The strainer 21 in this case lies on top of the inner plate 30. The inner plate 30 prevents dripping after the brewing process.

On the bottom side of the lower capsule base 3, a molded second annular projection 17, which is coaxial with the capsule axle 12, projects downward, a diameter of the second annular projection 17 being equal to or smaller than a diameter of the first annular projection 11; the diameter of the second annular projection 17 is selected to be large enough so that the weak points 13 lie within the second annular projection 17.

The second annular projection 17 is encompassed on the outside by a dish-like hood 23 which forms a bottom outlet space 22 of the single-serve capsule 1, the dish-like hood 23 having a bottom, central beverage outlet 7.

When fluid pressure is built up in the interior of the single-serve capsule 1, the liquid flows from the interior space to the weak points 13 to open the weak points 13 to allow the liquid to reach the bottom outlet space 22 and the beverage outlet 7.

The arcuate thin spots 20 are molded and arranged to project from the lower capsule base 3 in a sloping way so that they rise in a ramp-like manner towards the outlet end 2 and rise toward the outer edge of the lower capsule base 3 to such an extent that the outer highest edge 20*a* of each thin spot 20 is more distant from the inlet end 4 than the remaining part of the area of the lower capsule base 3. The circular-arc-shaped thin spots 20 thereby have the shape of a sector of the wall of a hollow truncated cone. Due to this extension of the surface of the thin spots 20, the hot liquid has a stronger impact on the thin spots 20 so that they deflect downward more strongly.

Between the thin spots 20 and the weak points 13 are transitional areas 25 through which the thin spots 20 act on the weak points 13. As soon as hot water is pressed into the interior of the single-serve capsule 1, the water exerts significant forces on the ramp-like thin spots 20 which as a result of their sloping surface are moved by the water so that their respective two ends exert tensile and/or compressive forces via the transitional areas 25 on the weak points 13 so that these tear open more easily.

Figure 7:
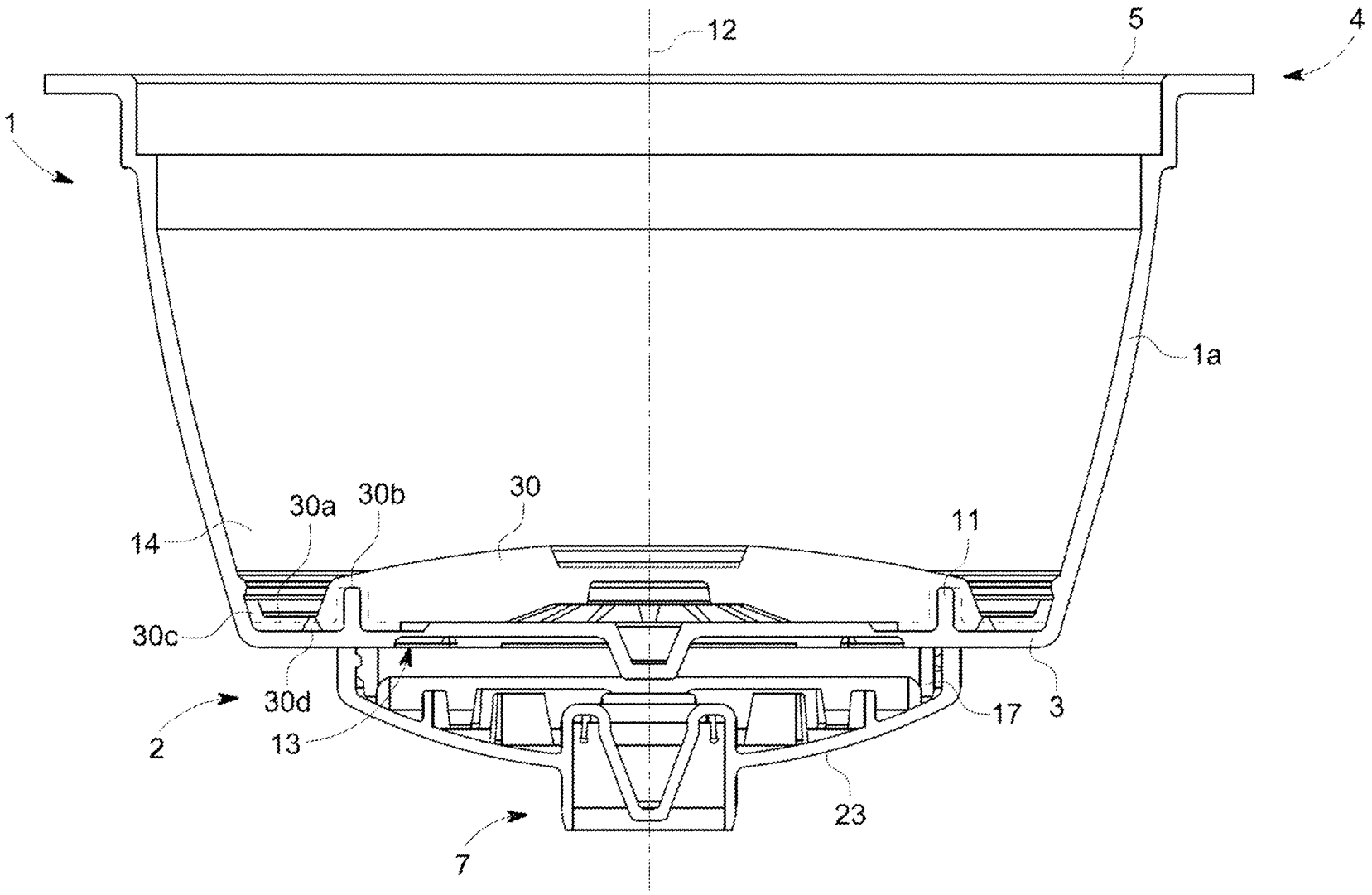
FIG. 7 shows an axial section through another embodiment.

The inner plate 30 (in particular acting as strainer) has a diameter that is large enough for the inner plate 30 to cover the entire lower capsule base 3 and to extend with its outer edge 30*a* to the external wall 1*a* of the pot-like single-serve capsule. An upward curved annular zone 30*c* of the outer edge 30*a* can, for example, abut the inside of the external wall 1*a* (FIG. 7).

The inner plate 30 has at its bottom side an annular groove 30*b* in which the first annular projection 11 of the lower capsule base 3 is located. The inner plate 30 is thus higher than the first annular projection 11.

Figure 8:
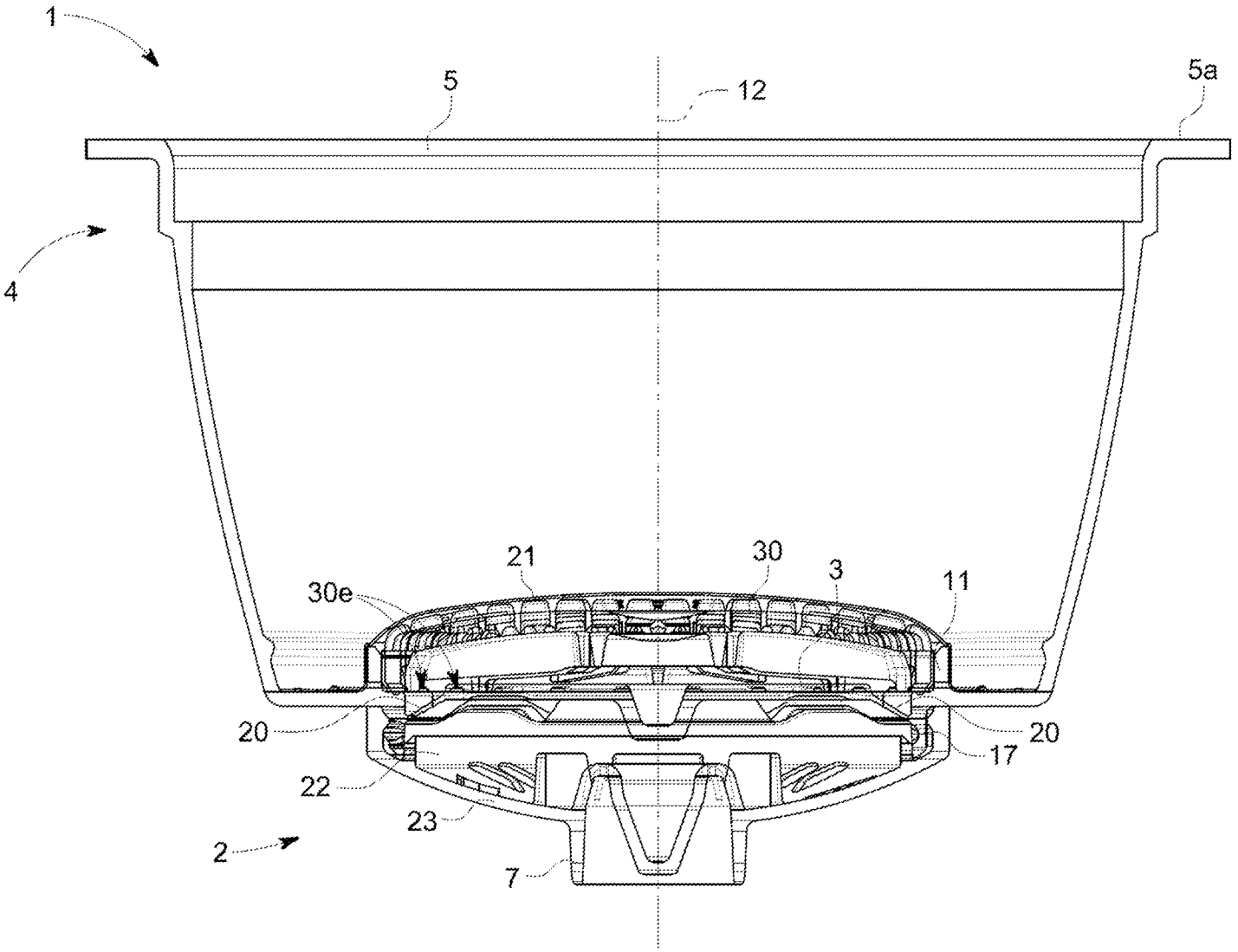
FIG. 8 shows a view of the single-serve capsule of the present invention where the liquid channels are visible.
Figure 9:
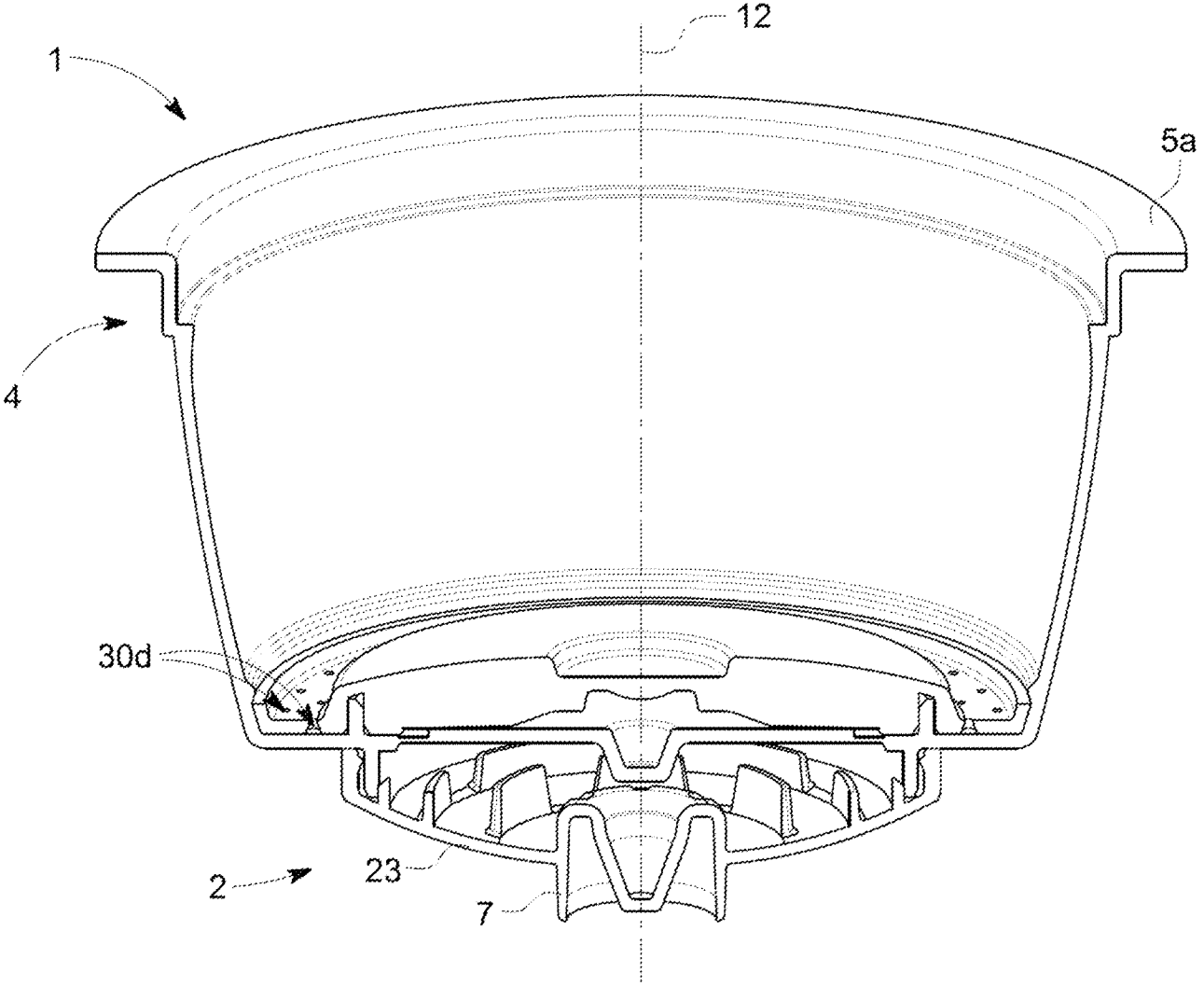
FIG. 9 shows a view of the single-serve capsule of the present invention where the liquid passages are visible.

At its bottom side between the upward curved annular zone 30*c* and beyond the annular groove 30*b*, the inner plate 30 has numerous liquid channels 30*e* which correspond to the liquid passage openings 30*d* and guide the finished beverage to the weak points 13 of the single-serve capsule 1. See FIGS. 8 and 9.

The present invention is not limited to embodiments described herein; reference should be had to the appended claims.

What is claimed is:

1. A single-serve capsule made of a plastic for preparing a beverage in a beverage apparatus, the single-service capsule comprising:

an inlet end which is configured to be perforated by a device to allow hot water to be pressed into an interior of the single-serve capsule in which a beverage substrate, beverage granules, or a beverage powder is provided;

an outlet end which is arranged opposite to the inlet end;

a capsule base which is configured to close the outlet end, the capsule base comprising, an outside area, an outer edge, weak points which are configured to at least one of open, break and tear as a result of a fluid pressure of the hot water in the interior of the single-serve capsule so as to allow a liquid to pass from the interior of the single-serve capsule to an outside of the single-serve capsule, and arcuate thin spots arranged next to each of the weak points, the arcuate thin spots being thinner than a surrounding base area, the arcuate thin spots being configured, to not break or tear open under the fluid pressure of the hot water, to form ramp-like sloping surfaces so as to increase a surface of the arcuate thin spots upon which the fluid pressure of the hot water acts, and to project upwards from the outside area of the capsule base and to rise towards the outer edge of the capsule base so that an outer highest edge of each of the arcuate thin spots is more distant from the inlet end than a remaining part of an area of the capsule base;

an inner plate which is configured to form a straining area, the inner plate being arranged to lie on and to cover the capsule base, the inner plate comprising a plurality of liquid passage openings;

the capsule base further comprising an inner projection to project upwards from the capsule base and an outer projection projecting downwards from the capsule base; and the inner plate engages with the inner projection which is of a greater diameter than the lower projection, the lower projection engages a hood and the weak points and arcuate thin spots have a diameter that is less than the lower projection.

2. The single-serve capsule as recited in claim 1, wherein each of the arcuate thin spots are configured to be circular and to have a shape of a sector of a wall of a hollow truncated cone.

3. The single-serve capsule as recited in claim 2, the single-serve capsule further comprises a center axis, and the weak points and the arcuate thin spots are arranged to lie on a circle which shares its axis with the center axis.

4. The single-serve capsule as recited in claim 3, wherein, 3 to 6 of the weak points are arranged at identical intervals on the circle, and intermediate circular spaces between the 3 to 6 weak points are respectively filled by the arcuate thin spots.

5. The single-serve capsule as recited in claim 4, wherein the arcuate thin spots and the 3 to 6 weak points are arranged to border on one another, in each case, with a transitional area through which the arcuate thin spots exert at least one of a tensile force and a compressive force on the 3 to 6 weak points when the hot water flows in.

6. The single-serve capsule as recited in claim 1, wherein, each of the arcuate thin spots have a circular arc length of 50' to 85°, and each of the weak points have a circular arc length of 5° to 20°.

7. The single-serve capsule as recited in claim 6, further comprising:

a transitional area where one of the arcuate thin spots is arranged next to one of the weak points.

8. The single-serve capsule as recited in claim 1, wherein, the weak points each have a wall thickness of 0.10 to 0.30 mm, and the arcuate thin spots each have a wall thickness of 0.20 to 0.30 mm.

9. The single-serve capsule as recited in claim 1, wherein, the weak points each have a width of 0.10 to 0.30 mm, and the arcuate thin spots each have a width of 1.0 to 2.0 mm.

10. The single-serve capsule as recited in claim 1, wherein the inner plate further comprises an annular groove and an annular zone which is upwardly curved, wherein, the plurality of liquid passage openings is arranged between the annular groove and the annular zone.

11. The single-serve capsule as recited in claim 10, further comprising:

an external wall, wherein, the inner plate further comprises an outer edge which extends to the external wall.

12. The single-serve capsule as recited in claim 11, wherein, the outer edge comprises the annular zone which is upwardly curved, and the outer edge comprising the annular zone which is upwardly curved is configured to abut on an inside of the external wall.

13. The single-serve capsule as recited in claim 10, wherein the inner plate further comprises, at the bottom side between the annular zone which is upwardly curved and beyond the annular groove, a plurality of liquid channels which correspond to the plurality of liquid passage openings, the plurality of liquid channels being configured to guide a finished beverage to the weak points of the single-serve capsule.

* * * * *